US005738163A

United States Patent [19]

Demukai et al.

[11] Patent Number: 5,738,163

[45] Date of Patent: Apr. 14, 1998

[54] LEVITATION MELTING METHOD AND A LEVITATION MELTING AND CASTING DEVICE

[75] Inventors: Noboru Demukai, Gifu-ken; Masayuki Yamamoto; Junji Yamada, both of Nagoya, all of Japan

[73] Assignee: Daido Tokushuko Kabushiki Kaisha, Nagoya, Japan

[21] Appl. No.: 628,582

[22] Filed: Apr. 3, 1996

[30] Foreign Application Priority Data

Jun. 26, 1995 [JP] Japan ..... 7-159215

[51] Int. Cl.[6] ..... B22D 27/02; B22D 27/15

[52] U.S. Cl. ..... 164/493; 164/63; 164/257; 164/258; 164/513

[58] Field of Search ..... 164/493, 63, 66.1, 164/68.1, 254, 257, 258, 147.1, 513, 255

[56] References Cited

U.S. PATENT DOCUMENTS

| | | | |
|---|---|---|---|
| 3,554,406 | 1/1971 | Kleysteuber . | |
| 5,193,607 | 3/1993 | Demukai et al. | 164/493 |

FOREIGN PATENT DOCUMENTS

| | | | |
|---|---|---|---|
| 0 392 067 A1 | 10/1990 | European Pat. Off. . | |
| 583124 | 2/1994 | European Pat. Off. | 164/493 |
| 1 172 010 | 12/1968 | Germany . | |
| 44 35 764 A1 | 4/1995 | Germany . | |
| 441062 | 2/1992 | Japan . | |
| 4-123844 | 4/1992 | Japan | 164/493 |
| 6071416 | 3/1994 | Japan . | |

OTHER PUBLICATIONS

Database WPI, Derwent Publications Ltd., London, GB, AN 95-203237, Abstract.

Database WPI, Derwent Publications Ltd., London, GB, AN 95-093314, Abstract.

*Primary Examiner*—Joseph J. Hail, III

*Assistant Examiner*—I. H. Lin

*Attorney, Agent, or Firm*—Davis and Bujold

[57] ABSTRACT

A levitation melting method and device through which a material having various configurations can be melted through efficient induction heating. First, a starting material (WB), whose outer diameter has been adapted to the inner diameter of a crucible(13), is inserted in crucible(13). The crucible(13) is shielded with argon gas, thereby starting the melting of the material(WB) to molten metal(WM). Subsequently, a suction tube(33) of a mold(31) is inserted into the molten metal(WM) for drawing a part of molten metal(WM) up into the mold(31) for casting. After part of the molten metal(WM) is drawn up, a sliding cover(15) is slid such that a material holder(19) is positioned right above the crucible(13). By opening a sliding plate(35) of the material holder(19), material pieces(WS) are inserted from the material holder(19) into the molten metal(WM) left in the crucible(13). Since gaps in the material pieces(WS) are filled with the molten metal(WM), a dense bulk is formed which is to be melted through induction heating.

17 Claims, 4 Drawing Sheets

LEVITATION MELTING METHOD AND A LEVITATION MELTING AND CASTING DEVICE

FIELD OF THE INVENTION

This invention relates to a levitation melting method in which material is introduced into a water cooled copper crucible with an induction heating coil wound therearound and the material is melted, such that molten metal is prevented from being brought in contact with inner wall surfaces of the crucible.

BACKGROUND OF THE INVENTION

Conventionally, when titanium or other high-melting point active metal is precision cast, as shown in FIG. 4, a cylindrical water-cooled copper crucible 101 is used. The outer periphery of crucible 101 is provided with a wound induction heating coil 103. Base material 105 is introduced from the bottom of crucible 101, and concurrently the inside of crucible 101 is shielded with argon gas. Molten metal is drawn up into a precision cast mold 107 to be cast, without being brought in contact with any inner wall surface of crucible 101 or being mixed with any foreign material. Such a levitation melting method is disclosed in, for example, published Japanese patent application No. 4-41062.

In the conventional levitation melting method, after molten metal is drawn up into the cast mold 107, the base material 105 is elevated to form new molten metal for the subsequent casting process.

The base material 105, however, requires a specified cross-sectional configuration adapted to the configuration of crucible 101. Therefore, base material 105 has to be prepared beforehand, which adds steps to the manufacturing process. This is disclosed in, for example, published Japanese patent application No.6-71416.

To minimize the number of manufacturing process steps, scrap material can be introduced from the top of the crucible 101, thereby obviating the necessity of preparing the base material 105. Since the scrap material has various configurations, however, gaps are formed among the configurations of the scrap material, thereby decreasing the filling efficiency in the crucible 101. Furthermore, the induction heating efficiency is impaired and the melting rate is reduced. Consequently, the number of manufacturing process steps cannot be decreased sufficiently.

SUMMARY OF THE INVENTION

Wherefore, an object of the present invention is to provide a levitation melting method in which scrap material or other material having various configurations can be melted by means of efficient induction heating.

To attain this or other objects, the present invention provides a levitation melting method in which material is introduced into a water cooled copper crucible provided with an induction heating coil wound therearound and melted such that molten metal is prevented from contacting any inner wall surface of the crucible. When the molten metal is delivered, some molten metal is left in the crucible and additional material is introduced over the remaining molten metal, thereby repeating the melting step.

In the aforementioned levitation melting method, when additional material is added to the molten metal left in the crucible, gaps in the material are filled with the molten metal. Therefore, when the material, having an irregular configuration and low bulk density, is surrounded with the molten metal, the entire bulk density in the crucible is raised. Consequently, the additional material needs no specified cross-sectional configuration, and no process step for adjusting the configuration of the material is required. Even a material with a low bulk density and an irregular configuration can be melted efficiently.

Consequently, in the present invention the number of process steps and the manufacturing cost can be significantly reduced. When the method of the present invention is applied to a precision casting process, final products can be manufactured with remarkably low cost.

In the levitation melting method the quantity of molten metal left in the crucible is preferably sufficient for filling gaps in the additional material. For this purpose, the weight and bulk density of the additional material and the quantity of a single delivery of molten metal are determined such that the condition K<1.8 is satisfied in the following equation(1).

$$W_S = K \cdot W_M / \{K - 1 + (\rho_M / \rho_S)\} \quad (1)$$

$W_S$: the quantity of the additional material measured in kilograms;

$W_M$: the weight of molten metal before delivery measured in kilograms;

$\rho_M$: the specific gravity of molten metal measured in $g/cm^3$;

$\rho_S$: the bulk specific gravity of the material measured in $g/cm^3$; and

K: operational parameter.

The formation of equation (1) is now explained.

First, the estimated volume of gaps in the additional material in bulk, $V_S$, is expressed in the following equation (2).

$$V_S = (W_S/\rho_S) - (W_S/\rho_M) = W_S(1/\rho_S - 1/\rho_M) \quad (2)$$

The estimated volume of the molten metal left in the crucible, $V_R$, is expressed in the following equation (3).

$$V_R = (W_M - W_S)/\rho_M \quad (3)$$

If $V_S$ largely exceeds $V_R$, the material coarsely fills in the crucible, and the induction heating efficiency is thus decreased. The inventors knew from experience that there is a transition point of heating efficiency around the value $V_S = 1.8V_R$. If the value is in a range of $V_S = 1.5V_R$ and $V_S < 1.5V_R$, an excess drop in the heating efficiency can be avoided.

If $V_S$ is lower than $V_R$, the induction heating efficiency can be constantly maintained at a high value. However, a value of $V_S$ excessively lower than $V_R$ necessitates an excessively large facility for melting and casting. The inventors, upon review, concluded that when the lower limit of $V_S$ is around $0.5V_R$ the facility can be a realistic size.

When the effective range of the ratio of $V_S$ relative to $V_R$ is set as K, the relationship between $V_S$ and $V_R$ is expressed in following equation (4).

$$V_S = K \cdot V_R \quad (4)$$

The equation (4) is substituted with equations (2) and (3) and arranged to form the following equations (5) thru (7).

$$W_S(1/\rho_S - 1/\rho_M) = K \cdot (W_M - W_S)/\rho_M \quad (5)$$

$$W_S(1/\rho_S - 1/\rho_M + K/\rho_M) = K \cdot W_M/\rho_M \quad (6)$$

$$W_S = K \cdot W_M/(K - 1 + \rho_M/\rho_S) \quad (7)$$

The resulting equation(7) is equivalent to equation (1). As aforementioned, the effective range of value K is preferably no more than 1.8 and preferably between 0.5 and 1.5. Under this condition, the size of the facility is prevented from being excessively large.

In the levitation melting method of the present invention, material pieces or powder are blended to form material to be added into the crucible, the bulk specific gravity of which is determined such that the value of K is lower than 1.8 and preferably between 0.5 and 1.5 in the following equation (8).

$$\rho S=\rho M\cdot Ws/[K(WM-Ws)+Ws] \quad (8)$$

Ws: the weight of the additional material measured in kilograms;

WM: the weight of molten metal before delivery measured in kilograms;

ρM: the specific gravity of molten metal measured in $g/cm^3$;

ρS: the bulk specific gravity of material measured in $g/cms^3$; and

K: operational parameter.

The equation (8) is derived by arranging equation (7) for ρS.

For example, when precision casting is conducted using cast molds of the type used for mass production, the weight of the additional material, or Ws, is determined or limited by the dimension of the mold. To prepare a determined weight of the additional material, the blend rate of material pieces or powder having various configurations is predetermined so as to satisfy the requirements of equation (8).

In the present invention the weight of molten metal before delivery, or WM, can be varied. If the conditions satisfy the equations (1) and (8), melting steps can be repeated while the value of WM is increased or decreased to a degree. Therefore, the quantity of the additionally introduced material and the bulk specific gravity of the material can be varied as long as these values are in such a range as to satisfy the requirements of equations (1) and (8).

The levitation melting method according to the present invention, in which foreign material is prevented from entering the molten metal in the crucible, is especially suitable for melting titanium, chromium, molybdenum, nickel, alloys of these metals, or other high-melting point active metals. The method of the present invention is appropriate for a precision casting process or a so-called near net shape casting process. In the near net shape casting process, molten metal is cast into a configuration close to that of a final product, requiring little material to be cut or finished. The method of the present invention can be applied for melting metals other than those specified above, and for other casting processes, for example, to form ingots or billets. The present invention can provide a levitation melting method in which while, or after, an almost predetermined quantity of molten metal is delivered from the crucible, another melting step is continued, for any purpose, using any material to be melted.

The present invention also provides a levitation melting and casting facility composed of a water cooled copper crucible provided with an induction heating coil therearound. The bottom of the crucible is blocked with material identical to the material to be melted in the crucible. Concurrently, the inside of the crucible is shielded with inactive gas. By conducting electricity to the induction heating coil, the material in the crucible is melted. A suction tube of a cast mold is inserted through the top of the crucible into the molten metal, for a suction casting process. The crucible is provided with a material holder for receiving material to be additionally melted. After the suction casting process is completed, the material holder is positioned on the top of the crucible, replacing the cast mold, and the material is injected from the material holder into the crucible. The facility according to the present invention is different from the conventional levitation melting and casting facility in that the material is additionally introduced from the material holder down into the crucible. Therefore, the material can be prepared so as to satisfy the conditions specified in the equations (1) and (8) and stored in the material holder, before being additionally injected into the crucible.

BRIEF DESCRIPTION OF THE DRAWINGS

The invention will now be described, by way of example, with reference the drawings, in which.

DETAILED DESCRIPTION OF THE PREFERRED EMBODIMENTS

Figure 1:
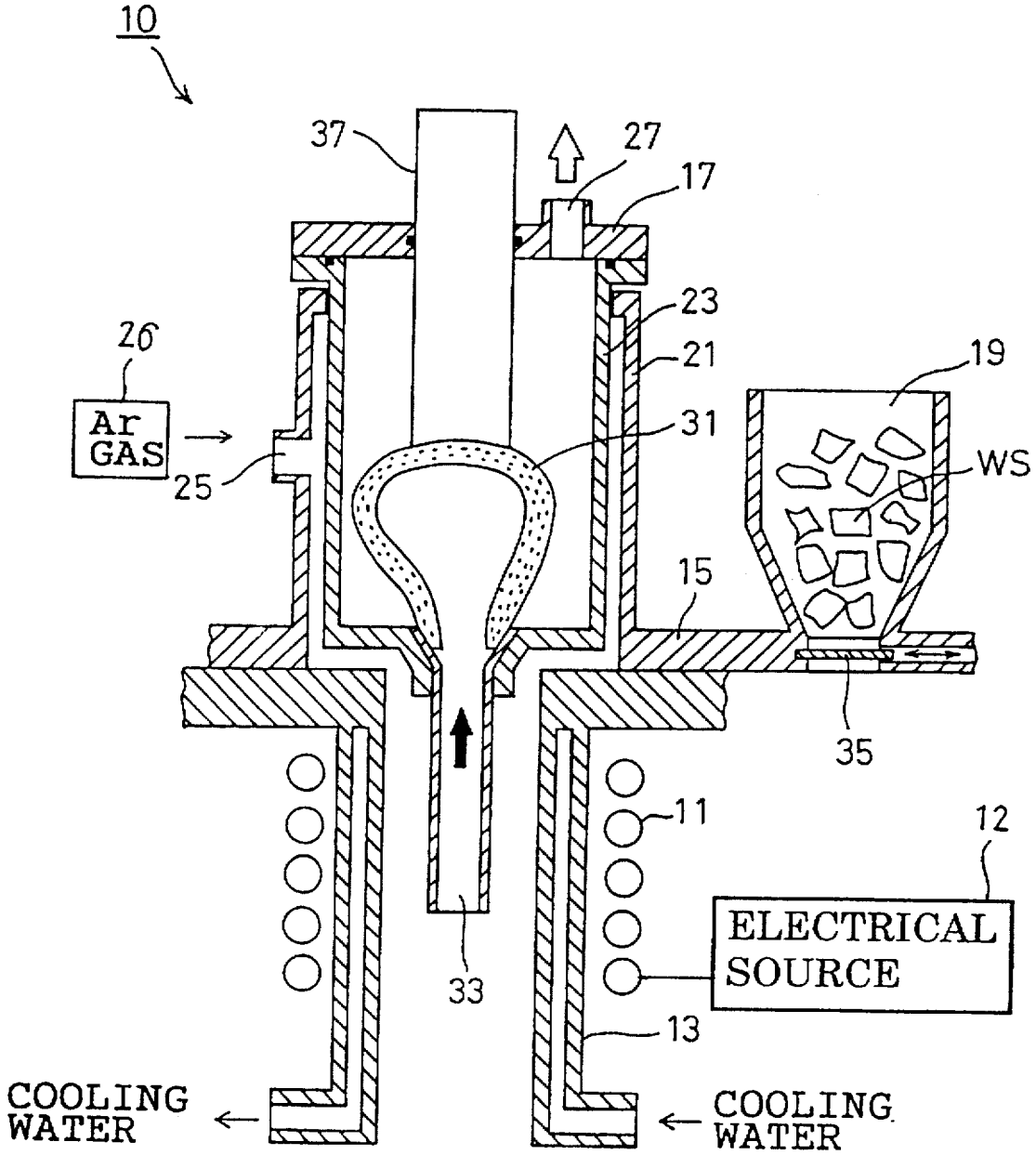
FIG. 1 is an explanatory view of a levitation melting and casting device embodying the present invention.

In one embodiment, shown in FIG. 1, a golf club head of titanium alloy is precision cast into an almost final configuration in a melting and casting facility 10. The melting and casting facility 10 is provided with a cylindrical water-cooled copper crucible 13 having an induction heating coil 11 wound therearound, a sliding cover 15 slidably mounted on the top of the crucible 13, a suction vacuum arrangement 17 mounted on the sliding cover 15, and a material holder 19, also mounted on the sliding cover 15.

The suction arrangement 17 has a dual cylindrical structure composed of an outer cylindrical part 21, and an inner cylindrical part 23 vertically slidable in the outer cylindrical part 21. The outer cylindrical part 21 is provided with an argon gas inlet 25. During the melting and casting, argon gas is blown from an argon supply source 26 to the inlet 25 through a gap in the bottom of outer cylindrical part 21 into the crucible 13 in a shielding manner. The inner cylindrical part 23 is provided with a pressure reduction port 27 communicating with a vacuum pump (not-shown). A precision cast mold 31 is provided in the inner cylindrical part 23 for suction casting. A suction tube 33 is extended downward from the bottom of the cast mold 31. Through the suction arrangement 17 a cast mold pressure rod 37 is extended toward the cast mold 31. By lowering the inner cylindrical part 23, the lower end of suction tube 33 is brought into contact with the molten metal. By reducing pressure via the pressure reduction port 27, molten metal is drawn up into the cast mold 31 to be molded.

The material holder 19 has a sliding plate 35 on the bottom thereof. Material pieces WS, which have been inserted via the top of material holder 19, are dropped down from the bottom of material holder 19 to be melted and cast. The material pieces WS are blended and measured, satisfying the requirements defined in equations (1) and (8), before being inserted into the material holder 19.

As shown in FIGS. 2A, 2B, 2C and 2D, the melting and casting process is repeated using the aforementioned melting and casting facility 10.

Figure 2A:
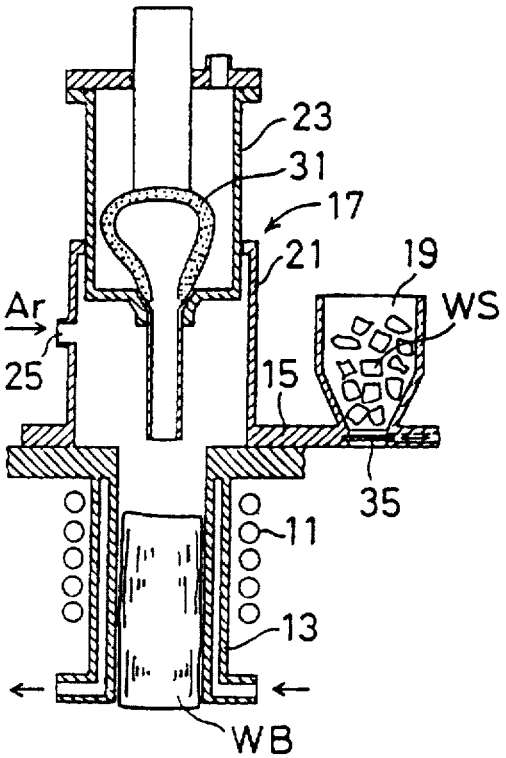
FIG. 2A, 2B, 2C and 2D are explanatory views showing process steps embodying the present invention.

First, a starting material rod WB, whose cross-sectional configuration has been adapted to the inner diameter of crucible 13, is inserted into the crucible 13. The sliding cover 15 is slid and positioned such that the crucible 13 is vertically aligned with the outer cylindrical part 21 of suction arrangement 17. Argon gas is blown from the inlet 25 into the crucible 13, thereby shielding the inside of crucible 13. Electricity, from electrical source 12, is conducted through the induction heating coil 11, initiating melting of the starting material rod WB. At this stage the inner cylindrical part 23 of suction arrangement 17 is elevated as shown in FIG. 2A.

Figure 2B:
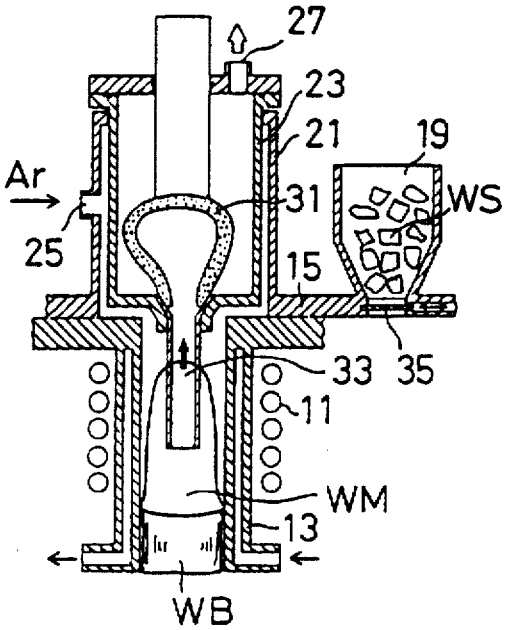

Through the levitation melting, part of the starting material rod WB is formed into molten metal WM. Subsequently, as shown in FIG. 2B, the inner cylindrical part 23 of suction arrangement 17 is lowered and the suction tube 33, extending from the cast mold 31, is inserted into the molten metal WM. Part of molten metal WM is drawn into the cast mold 31 to be cast. The amount of molten metal drawn is limited to a constant value by the dimension of cast mold 31.

Figure 2C:
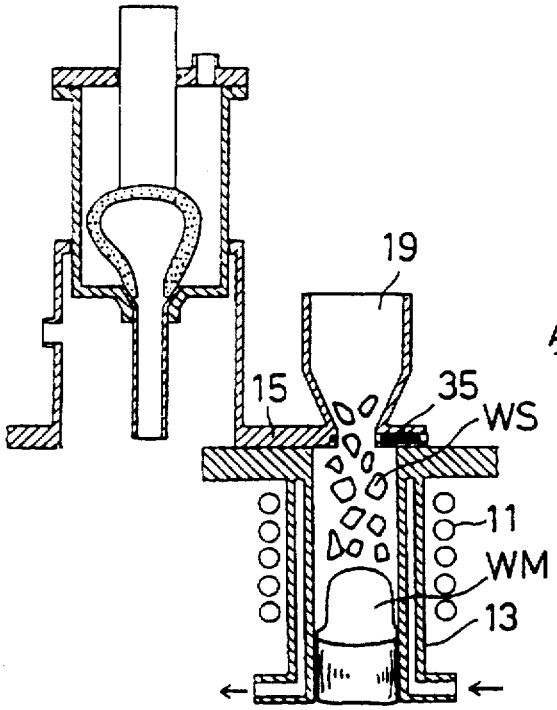

After completing the suction of the constant amount of molten metal into the cast mold 31, as shown in FIG. 2C, the sliding cover 15 is slid and positioned such that the material holder 19 is vertically aligned with the crucible 13. By opening the sliding plate 35, material pieces WS are added to the molten metal WM remaining in the crucible 13.

Figure 2D:
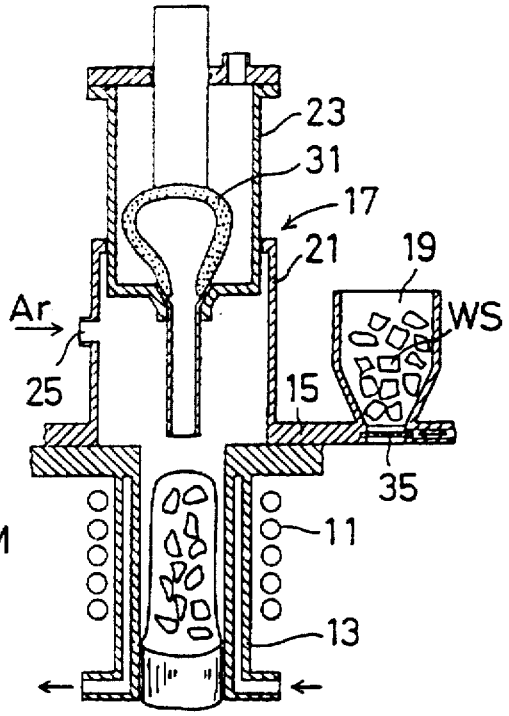

Before being added as aforementioned, the material pieces WS are blended such that they have a bulk specific gravity ρs satisfying the requirements of equations (1) and (8). Also, the material pieces WS are weighed so as to have almost the same weight as the weight of the molten metal to be delivered. The material pieces WS themselves form a bulk having gaps therein. When they are added to the molten metal WM remaining in the crucible 13, however, the gaps in the material pieces WS are filled with the molten metal WM thereby forming a dense bulk. Such dense bulk is heated by the induction heating coil 11 as shown in FIG. 2D. Consequently, the added material pieces WS can be quickly melted without deteriorating the heating efficiency.

While the material pieces WS are added and melted, the cast mold 31 is replaced with another cast mold. While the suction casting is executed, additional material pieces WS are inserted into the material holder 19.

The aforementioned steps of melting, suction casting and adding of materials are repeated, thereby efficiently manufacturing desired cast products.

Experimental examples of levitation melting are now explained. In the experiments, the aforementioned melting and casting facility 10 of the embodiment and an alloy material composed of 90% by weight of titanium, 6% by weight of aluminum and 4% by weight of vanadium were used. Using the values of the parameters in the aforementioned equations shown in Table 1, the period of time required for melting the additional material was measured.

TABLE 1

| EXPERIMENT No. | 1 | 2 | 3 | 4 | 5 | 6 | 7 | 8 | 9 | 10 |
|---|---|---|---|---|---|---|---|---|---|---|
| $W_M$ (kg) | 3.00 | 3.00 | 3.00 | 3.00 | 3.00 | 3.00 | 3.00 | 3.00 | 3.00 | 3.00 |
| $W_S$ (kg) | 1.33 | 1.17 | 1.13 | 1.19 | 1.09 | 1.42 | 1.62 | 1.69 | 1.75 | 1.58 |
| $\rho_M$ (g/cm$^3$) | 4.5 | 4.5 | 4.5 | 4.5 | 4.5 | 4.5 | 4.5 | 4.5 | 4.5 | 4.5 |
| $\rho_S$ (g/cm$^3$) | 2.0 | 2.0 | 1.5 | 1.2 | 1.0 | 1.5 | 1.2 | 1.2 | 1.2 | 1.0 |
| K | 1.0 | 0.8 | 1.2 | 1.8 | 2.0 | 1.8 | 1.55 | 1.65 | 1.75 | 1.9 |
| MELTING TIME (sec.) | 60 | 53 | 55 | 94 | 110 | 135 | 55 | 59 | 64 | 75 |

Figure 3:
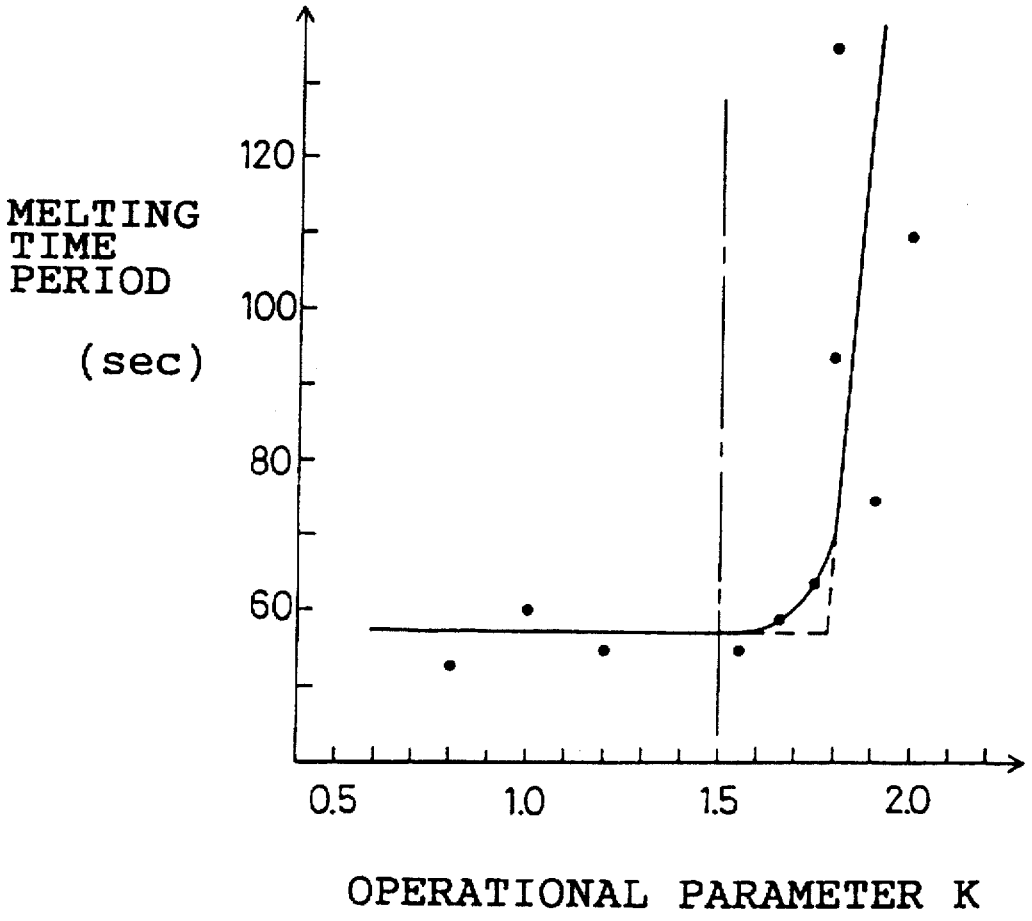
FIG. 3 is a graphical representation showing experimental results.
Figure 4:
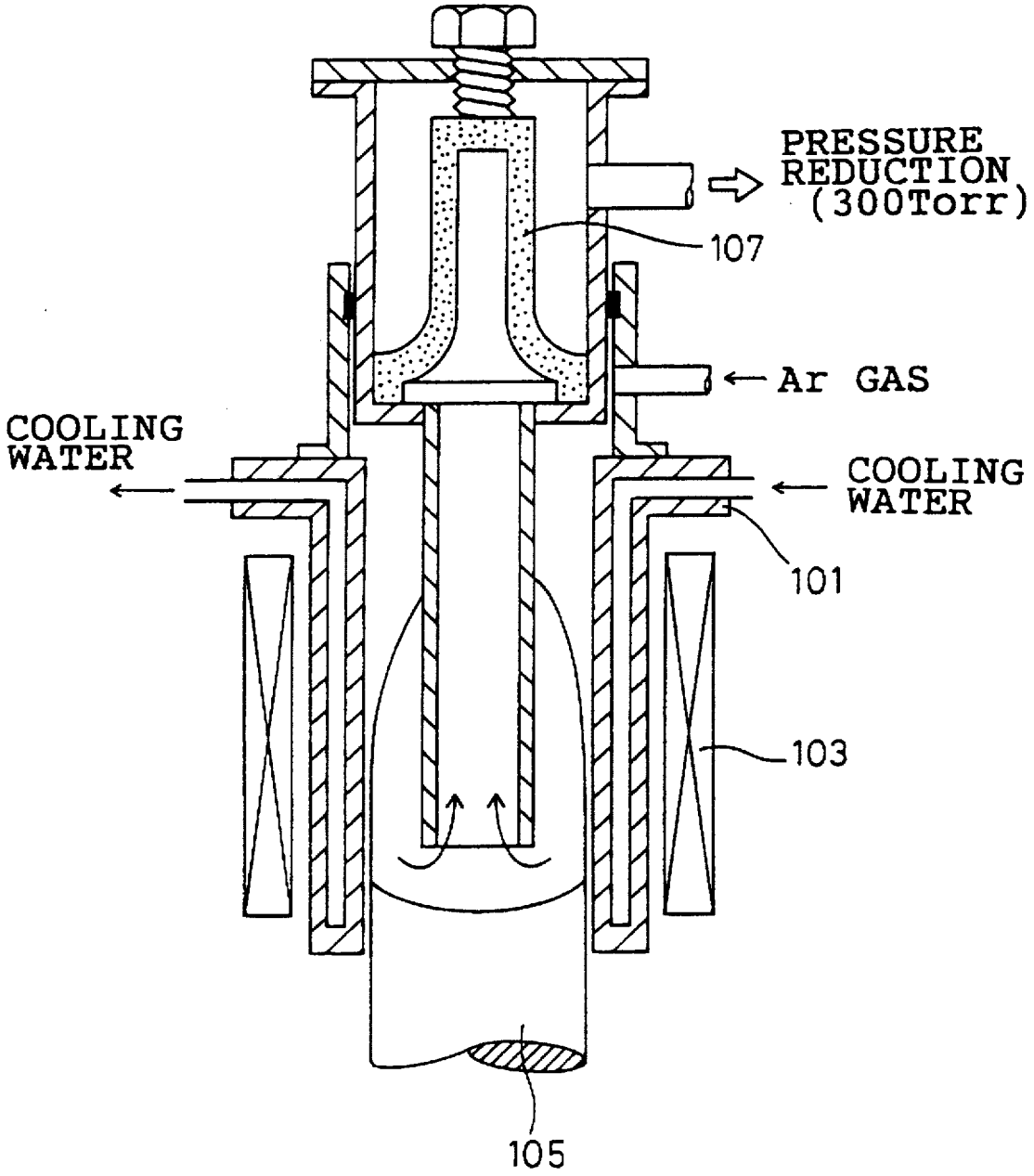
FIG. 4 PRIOR ART
FIG. 4 is explanatory view of a conventional levitation melting and casting device.

The experimental results are also shown in graph form in FIG. 3. For experiment Nos. 1–3, the time period required for melting was 60 seconds or shorter, and for experiment Nos. 4 and 5 the time period was longer. This indicates that when the operational parameter K is increased, gaps in the material pieces to be added are too large to be filled with the molten metal remaining in the crucible. Such coarse bulk of the material pieces and the molten metal requires a long time to be induction heated.

The time period for melting in experiment Nos. 4 and 6, in which operational parameter K equals 1.8, is longer by about 50% than that of the other examples. Therefore, a transitional point exists around the operational parameter K of 1.8. When the operational parameter K is lower than a certain value, the gaps in the material pieces are considered to be completely filled, and the time period for melting can be kept almost constant irrespective of the operational parameter K.

Considering that the transitional point exists around the operational parameter K of 1.8, shown by the dashed line in FIG. 3, the time period for melting stays constant irrespective of the operational parameter K when it is lower than a certain value. A solid line can be drawn by way of extrapolation in the graph of FIG. 3. This indicates that when the operational parameter K is lower than 1.5, the time period for melting is substantially constant.

A small value of operational parameter K indicates that the rate of molten metal to be delivered is reduced and the amount of molten metal to remain in the crucible is increased. If the operational parameter K is set to a very small value, a large crucible is required, thereby causing a practical problem in operation.

Consequently, the value of operational parameter K is preferably no more than 1.8, more preferably 1.5 or less and most preferably 1.2 or less. The lower limit of operational parameter K is preferably around 0.5.

This invention has been described above with reference to the preferred embodiment as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

What is claimed is:

1. In a levitation method of melting metal, in a water cooled copper crucible having an induction heating coil wound therearound, without contacting an inner surface of said water cooled copper crucible, the improved method comprising the steps of:

(a) delivering a portion of said molten metal to a casting mold for molding a desired product while a portion of said molten metal is still remaining in said water cooled copper crucible;

(b) adding additional metal pieces, from a metal holder, to said molten metal remaining in said water cooled copper crucible;

(c) melting said additional metal pieces to obtain molten metal such that molten metal is prevented from contacting an inner wall surface of said water cooled copper crucible;

(d) repeating said steps (a), (b) and (c).

2. The levitation melting method according to claim 1, further comprising the step of leaving a sufficient quantity of said molten metal in said water cooled copper crucible to fill air gaps present between said additional metal pieces.

3. The levitation melting method according to claim 2, further comprising the step of determining a weight and a bulk density of said additional metal pieces and a quantity of said delivered molten metal to satisfy a condition that K, in the following equation, is of a value lower than 1.8:

$$W_S = K \times W_M / \{K - 1 + (\rho_M / \rho_S)\},$$

in which $W_S$ denotes a quantity of said additional metal pieces, measured in kilograms;

$W_M$ denotes a weight of said molten metal before delivery, measured in kilograms;

$\rho_M$ denotes a specific gravity of said molten metal, measured in g/cm$^3$;

$\rho_M$ denotes a bulk specific gravity of said metal, measured in g/cm$^3$; and K denotes an operational parameter.

4. The levitation melting method according to claim 3, further comprising the step of using, as said operational parameter K, a value of between 0.5 and 1.5.

5. The levitation melting method according to claim 2, further comprising the step of using at least one of metal pieces and metal powder as said additional metal pieces such that a bulk specific gravity of said additional metal pieces satisfies a condition that K, in the following equation, is of a value lower than 1.8:

$$\rho_S = \rho_M \times W_S / \{K(W_M - W_S) + W_S\}.$$

in which $W_S$ denotes a weight of said additional metal pieces, measured in kilograms;

$W_M$ denotes a weight of said molten metal before delivery, measured in kilograms;

$\rho_M$ denotes a specific gravity of said molten metal, measured in g/cm$^3$;

$\rho_S$ denotes a bulk specific gravity of said metal, measured in g/cm$^3$; and K denotes an operational parameter.

6. The levitation melting method according to claim 5, further comprising the step of using, as said operational parameter K, a value of between 0.5 and 1.5.

7. The levitation melting method according to claim 1 further comprising the step of moving a sliding cover, provided on said water cooled copper crucible and supporting a metal holder, so that said metal holder is positioned above said crucible, after delivering a portion of said molten metal, for adding said additional metal pieces to said molten metal still remaining in said water cooled copper crucible.

8. A levitation melting and casting device comprising:

a water cooled copper crucible being provided with an induction heating coil therearound, said water cooled copper crucible being open at a top thereof; a bottom portion of said water cooled copper crucible being provided with a metal to be melted in said water cooled copper crucible;

a source of electricity being coupled to said induction heating coil for supplying electricity thereto and, during use, heat from said induction heating coil melting said metal in said water cooled copper crucible;

a source of inert gas being coupled to said water cooled copper crucible for supplying, during use, an inert gas thereto;

a vacuum tube of a casting mold being positionable over the top of said water cooled copper crucible and, during use, being insertable into said molten metal for delivering a portion of said molten metal to said casting mold during a suction casting process while a portion of said molten metal still remaining in said water cooled copper crucible; and a metal holder for containing additional metal pieces to be melted in said levitation melting and casting device;

wherein after said molten metal is drawn up into said casting mold during the suction casting process, said metal holder is movable to a position located over said water cooled copper crucible to supply said additional metal pieces from said metal holder into said water cooled copper crucible for melting in said water cooled copper crucible.

9. A levitation melting and casting device comprising:

a water cooled crucible being provided with an induction heating coil therearound, said water cooled copper crucible being open at a top thereof, and said induction coil being supplied, during use, with electricity for melting said material;

a metal being provided in a bottom portion of said water cooled crucible;

a sliding cover being mounted to said water cooled crucible; suction means, for delivering a portion of said molten metal to a casting mold during a suction casting process while a portion of said molten metal still remaining in said water cooled copper crucible, being mounted to a first portion of said sliding cover; and a metal holder, for containing and supplying additional metal pieces to be melted by said levitation melting and casting device, being mounted on a second portion of said sliding cover; and said sliding cover being movable from a first position, in which said suction means draws a portion of said molten metal into said casting mold, to a second position, in which said metal holder supplies said additional metal pieces to be melted by said levitation melting and casting device.

10. A levitation melting and casting device according to claim 9, wherein said water cooled crucible is formed from copper.

11. A levitation melting and casting device according to claim 9, wherein said metal holder includes a sliding plate mounted to a bottom surface thereof for supporting said additional metal pieces, and said sliding plate is movable from a first position, in which said sliding plate supports said additional metal pieces, to a second position in which said sliding plate facilitates supplying said additional metal pieces, to be melted by said levitation melting and casting device, to said water cooled crucible.

12. A levitation melting and casting device according to claim 9, wherein said suction means comprises:

an outer portion suction device;

an inner portion suction device slidably contained within said outer portion suction device and movable relative thereto;

a gas inlet provided within said outer portion suction device, said gas inlet being couplable to a source for providing a shielding gas to said water cooled crucible;

a pressure reduction port provided within said inner portion suction device for providing communication, via a conduit, with a vacuum device;

a precision casting mold provided within said inner portion suction device for suction casting; and a suction tube projecting from said precision casting mold for drawing, during use, a portion of said molten material into said precision casting mold.

13. A levitation melting and casting device according to claim 12, wherein a casting mold pressure rod extends through said suction means to said precision casting mold.

14. A levitation melting and casting device according to claim 12, wherein said outer portion suction device is cylindrical in shape.

15. A levitation melting and casting device according to claim 12, wherein said inner portion suction device is cylindrical in shape.

16. A levitation melting and casting device according to claim 12, wherein said suction tube is located adjacent said molten metal to facilitate drawing a portion of said molten material into said precision casting mold when a pressure in said inner portion is reduced via said pressure reduction port.

17. A levitation melting and casting device according to claim 12, wherein said shielding gas is argon.

* * * * *